United States Patent [19]

Giampa et al.

[11] Patent Number: 4,774,913

[45] Date of Patent: Oct. 4, 1988

[54] VARIABLE VALVE LIFT/TIMING MECHANISM

[75] Inventors: Rolland D. Giampa, Clarkston; Douglas K. Mehaffey, Fraser, both of Mich.

[73] Assignee: General Motors Corporation, Detroit, Mich.

[21] Appl. No.: 104,285

[22] Filed: Oct. 5, 1987

[51] Int. Cl.[4] ..... F01L 1/12; F01L 1/24

[52] U.S. Cl. ..... 123/90.16; 123/90.46

[58] Field of Search ..... 123/90.16, 90.39, 90.46

[56] References Cited

U.S. PATENT DOCUMENTS

| | | | |
|---|---|---|---|
| 3,413,965 | 12/1968 | Gavasso | 123/90.16 |
| 4,498,432 | 2/1985 | Hara et al. | 123/90.16 |
| 4,526,142 | 7/1985 | Hara et al. | 123/90.16 |
| 4,638,773 | 1/1987 | Bonvallet | 123/90.16 |
| 4,724,822 | 2/1988 | Bonvallet | 123/90.16 |

FOREIGN PATENT DOCUMENTS

| | | | |
|---|---|---|---|
| 60-132010 | 7/1985 | Japan | 123/90.39 |

*Primary Examiner*—Andrew M. Dolinar
*Attorney, Agent, or Firm*—Arthur N. Krein

[57] ABSTRACT

A variable valve lift and timing valve train mechanism includes a rocker arm having one end thereof operatively engaging a valve and its opposite end being engaged by a valve actuator, the upper surface of the rocker arm intermediate its ends having a predetermined cam surface profile which is adapted to cooperate with a working surface of an angular movable reaction member used to provide a fulcrum to thereby effect pivotal movement of the rocker arm in a valve opening direction. The point of line contact between the cam surface of the rocker arm against the working surface of the upper reaction member and the geometry of the upper surface of the rocker arm cooperate to control the amount of valve lift and its timing. The angular position of the reaction member used to control valve lift being controlled by a pivotable eccentric engaging an axially movable slide pin device interposed between the pivotable eccentric and the reaction member.

4 Claims, 4 Drawing Sheets

VARIABLE VALVE LIFT/TIMING MECHANISM

FIELD OF THE INVENTION

This invention relates to valve train mechanisms for internal combustion engines and, in particular, to a variable valve lift and variable timing valve train mechanism.

DESCRIPTION OF THE PRIOR ART

Various variable valve lift, valve train mechanisms are well known. For example, in U.S. Pat. Nos. 4,498,432 and 4,526,142 both entitled "Variable Valve Timing Arrangement for an Internal Combustion Engine or the Like", issued Feb. 12, 1985 and July 2, 1985, respectively, in the names of Seinosuke Hara, Schunichi Aoyama and Kazuyuki Miisho, and in U.S. Pat. No. 4,638,773 entitled "Variable Valve Lift/Timing Mechanism", issued Jan. 27, 1987 to Duane J. Bonvallet, there is disclosed a type of variable lift valve train mechanism in which a rocker arm is positioned so that one end thereof is adapted to be actuated either directly by a cam or by a cam actuated push rod while its other or opposite end operatively engages the free stem end of a poppet valve, such as an intake valve or exhaust valve. The upper surface of the rocker arm has a contoured portion which is adapted to abut against an upper reaction member or lever, with the contact point between the rocker arm and the lever serving as the pivot or fulcrum point of the rocker arm. The lever itself is adapted to have its angular position changed, as desired, by means of a second cam or eccentric, whereby to, in effect, vary the effective pivotable movement of the rocker arm to thereby vary both valve lift and the timing thereof. In the U.S. Pat. No. 4,638,773 mechanism either the rocker arm or the reaction member has a predetermined reaction cam contour profile thereon whereby the lift-off and landing profiles of the poppet valve actuated thereby are unchanged by the amount of lost motion introduced between the rocker arm and the reaction member.

SUMMARY OF THE INVENTION

The present invention relates to an improved variable valve lift and timing valve train mechanism that includes a rocker arm having one end thereof adapted to be operatively associated with a valve actuator, such as a push rod associated with the cam on a rotatable camshaft, the opposite end of the rocker arm being pivotably and operatively engaged with the ball-shaped free stem end of a poppet valve; an upper reaction member having one end thereof pivotable about a center on the axis of the stem of the poppet valve when the poppet valve is in a valve closed position. The upper reaction member is normally biased toward the free stem end of the poppet valve by means of a suitable lash adjuster, and the opposite end of the upper reaction member is adapted to be engaged by an L-shaped slidable guide pin which in turn is engaged by a rotatable eccentric mechanism whereby valve lift and timing can be varied as desired, with the upper surface of the rocker arm or reaction member intermediate its ends having a preeetermined contour shaped, as desired, to produce a desired lift-off and landing motion profile of the poppet valve. A spring mechanism operatively interconnects the rocker arm with the push rod and maintains the latter in biased engagement with the cam.

It is therefore a primary object of this invention to provide an improved variable valve lift and timing valve train mechanism of the type having a rocker arm pivotable on an upper reaction member wherein the control of the opening and closing of a poppet valve is, in effect, transferred from the usual cam on a camshaft to the rocker arm by providing a predetermined contour on either of the opposed working surfaces of the rocker arm or on the upper reaction member, the other surface, being a flat uurface and having the pivotable position of the reaction member controlled by a guide pin engaged by an eccentric.

A further object of the invention is to provide an improved variable lift and timing valve train mechanism of the type introducing lost motion between a cam actuated rocker arm and an associated upper reaction member, wherein one of the elements has a predetermined reaction cam contour profile thereon whereby the lift-off and landing profiles of an associated poppet valve actuated thereby are unchanged by the amount of lost motion and wherein an eccentric cam lobe on an actuating shaft via a slidable slide pin is used to control the angular position of the reaction member and a spring mechanism interconnects the rocker arm with a cam actuated push rod.

A further object of this invention is to provide an improved variable lift and timing valve train mechanism of the type introducing lost motion between a cam actuated rocker arm and an associated upper reaction member, wherein pivotal motion of the upper reaction member to change valve lift does not in itself cause valve lift and wherein a spring mechanism connects the rocker arm to a push rod, the arrangement being such that the rocker arm is operatively connected to the push rod which in turn is biased into operative engagement with a cam on an engine driven camshaft.

For a better understanding of the invention as well as other objects and further features thereof, reference is had to the following detailed description of the invention to be read in connection with the accompanying drawings.

DESCRIPTION OF THE PREFERRED EMBODIMENT

Figure 1:
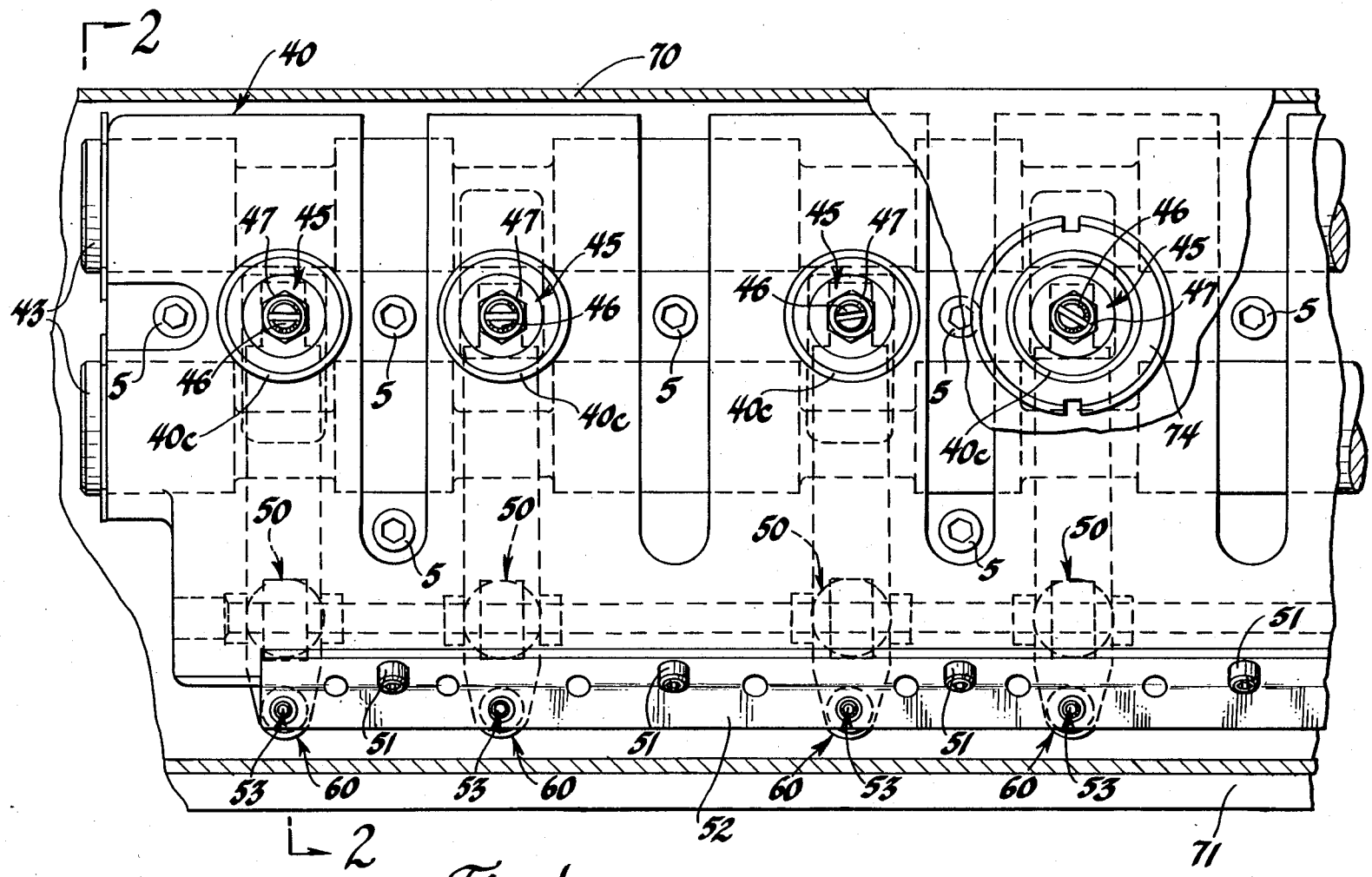
FIG. 1 is a top view of a portion of a bank of cylinders of an internal combustion engine with a variable valve lift and timing valve train mechanism in accordance with the invention incorporated therein, with parts such as a valve cover, etc. broken or removed therefrom.

Referring first to FIG. 1, for purpose of illustration only, there is shown a portion of one bank of aligned cylinders of a V-6 type internal combustion engine, of the overhead valve type, having an exhaust valve and an inlet valve, only one being shown, per engine cylinder. As shown in FIG. 1, there is an exhaust valve and an intake valve for each cylinder, not shown in FIG. 1. However, since the subject valve train mechanism is the same for both an inlet valve and an exhaust valve, this valve train mechanism will be described as it relates to one poppet valve, either intake or exhaust.

Figure 2:
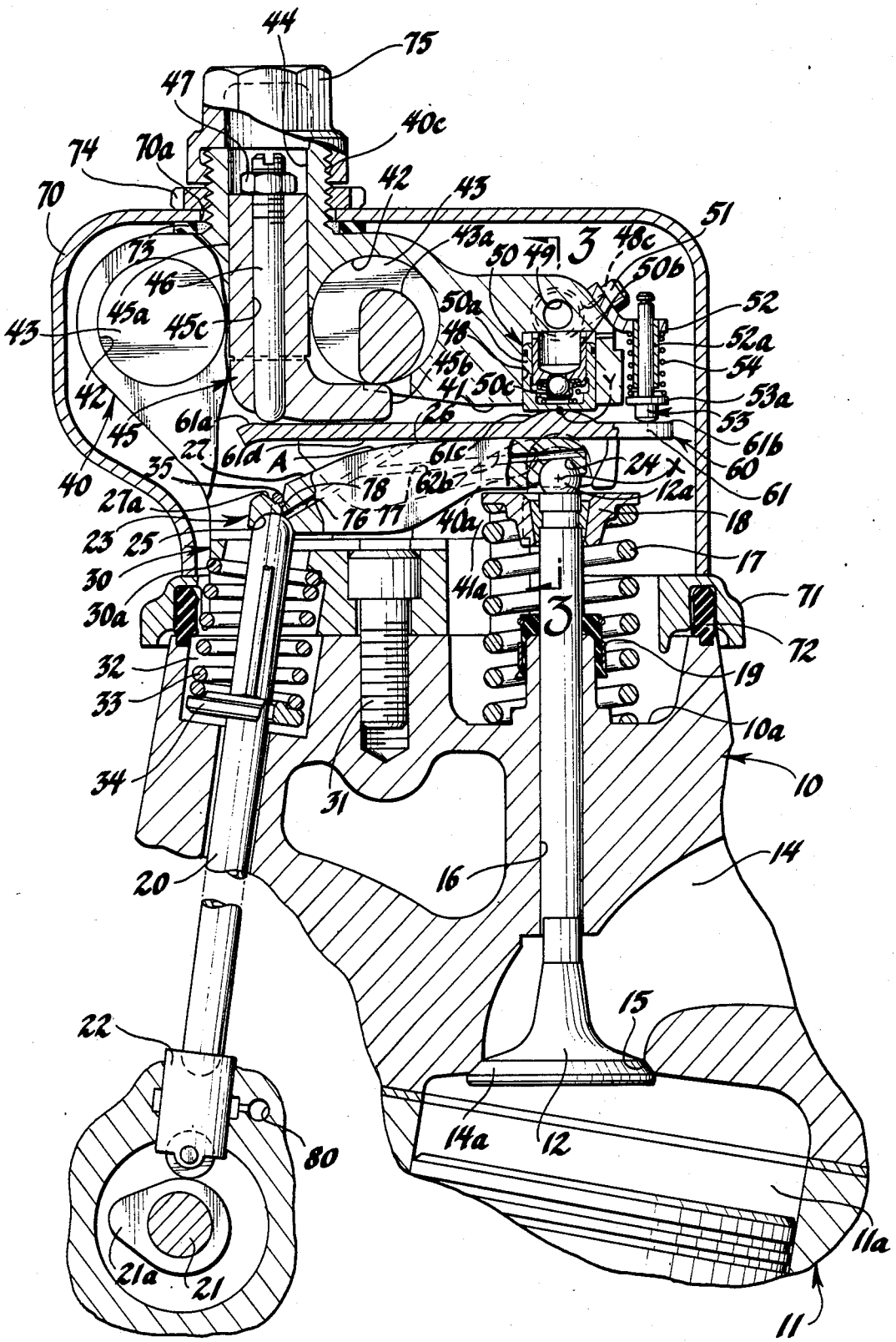
FIG. 2 is an elevational view, partially in section and taken approximately along line 2—2 of FIG. 1 to show a portion of an internal combustion engine with a variable valve lift and timing valve train mechanism in accordance with the invention incorporated therein, with the poppet valve shown in a closed position and the upper reaction member of the mechanism positioned to obtain maximum valve lift.
Figure 3:
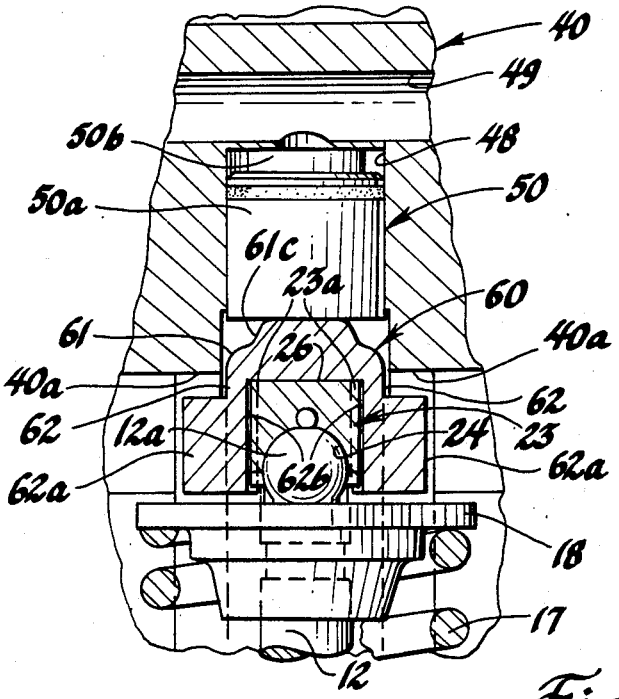
FIG. 3 is a sectional view taken along line 3—3 of FIG. 2 showing the operational relationship between the lash adjuster in the eccentric shaft housing, upper reaction member and the end of the rocker arm engaging the free stem end of an associate poppet valve to illustrate how the upper reaction member can be pivoted about a center on the longitudinal axis of the poppet valve.

Referring now in particular to FIG. 2, there is shown a portion of one cylinder bank of an internal combustion engine having an engine body means that includes a cylinder head 10 fixed to a cylinder block 11 having a plurality of in-line cylinders 11*a* therein and in which a valve 12, in the form of a poppet valve, either intake or exhaust, is operatively mounted to control fluid flow through a passage 14 having at one end a port 14*a* encircled by a conventional valve seat 15, with a variable lift and timing valve train mechanism, in accordance with the invention, operatively associated with the valve 12.

As is conventional, the valve 12 is guided for axial reciprocation as in a valve stem guide bore 16, with the upper stem end or ball end 12*a* of the valve projecting above the cylinder head 10. In a conventional manner, the valve 12 is normally maintained in a closed position, the position shown in FIG. 2, by a valve return spring 17, of a predetermined bias force as described in detail hereinafter, with one end of the spring 17 engaging the surface 10*a* of the cylinder head 10 and the other end of the spring engaging a conventional spring retainer assembly 18 secured to the stem of the valve 12 in a conventional manner. A conventional valve stem seal 19 is operatively positioned so as to sealingly engage an upper stem portion of the valve 12.

In the engine construction illustrated, a hollow push rod 20, which is reciprocably disposed in the cylinder head 10 laterally of the valve 12, has its upper semi-spherical end projecting above the cylinder head 10. As would be conventional, the lower end of the push rod 20 is operatively associated with a conventional roller follower type hydraulic tappet 22 engaging the cam 21*a* of a camshaft 21 in a conventional manner, whereby the push rod 20 and tappet 22 are caused to reciprocate as determined by the profile of the cam.

Motion of the push rod 20 is imparted to the valve 12 by means of a rocker arm 23 that is adapted to engage an upper reaction member 60 that can be positioned in a manner to be described whereby it can operate as a fulcrum about which the rocker arm 23 can pivot to effect opening and closing movement of the valve 12, as desired, in a manner to be described hereinafter.

In the construction illustrated, the rocker arm 23 is provided at opposite ends thereof with semi-spherical sockets 24 and 25 to socketably receive the upper semi-spherical ball ends 12*a* of the valve 12 and the push rod 20, respectively, the rocker arm 23 thus being adapted to pivot about a pivot axis X on the reciprocating axis of the valve 12 for a purpose to be described, as determined by the preselected radius of the ball end 12*a* of the valve 12 and the complementary radius of socket 24. Thus in a given engine application, these driven and drive ends of the rocker arm, corresponding to the push rod 20 and valve 12 engaging ends, respectively, are laterally spaced apart by a predetermined distance. For this purpose, each rocker arm 23, at its socket 24 end is provided on opposite sides thereof with outwardly extending bearing arms 23*a*, each of which is of semi-circular external configuration and predetermined radius and formed concentric with the socket 24 as seen from the side as shown in FIGS. 2 and 4–6.

In addition, in the construction shown, the upper surface of the rocker arm 23 is provided with a contoured working or cam surface 26 having a profile of generally convex configuration, which extends from a point B next adjacent to the socket 24 end, or right hand end with reference to FIGS. 2, 4, 5 and 6, of the rocker arm for a predetermined extent to a point A, as shown in these Figures, so as to merge into a downwardly extending surface 27, which, in effect, can be referred to as a non-working surface of the rocker arm as will become apparent hereinafter from an operational description of the subject valve train mechanism. The profile of the cam surface 26 is preferably calculated for each degree of rotation of the cam lobe 21*a* in a manner as disclosed in the above-identified U.S. Pat. No. 4,638,773, the disclosure of which is incorporated herein by reference thereto.

Referring again in particular to FIG. 2 and as shown therein, a longitudinally extending, base plate 30 is suitably secured as by spaced apart socket screws 31, only one being shown in this Figure, to the top of the cylinder head 10. In addition, an actuator shaft housing 40, having a stepped bottom, is suitably fixed to the base plate 30 and to the cylinder head 10 outboard of the base plate 30 as by elongated laterally and longitudinally spaced apart socket head cap screws 5, shown in FIG. 1, threaded into the cylinder head 10. The actuator shaft housing 40, at each intake and exhaust valve 12 position, on its lower side is provided with a suitably sized stepped through slot 41 to receive an associated rocker arm 23, reaction member 60 and a slide pin 45, both of the latter being described hereinafter.

Now in accordance with a feature of the subject invention, both the cylinder head 10 and base plate 30 are bored or otherwise formed so as to define a spring cavity 32, for each poppet valve 12, that is sized whereby to loosely receive an associated spring 33 therein. As shown, one end of each spring 33 abuts against an associated shoulder 30*a* of the base plate 30, while its opposite end engages an associate ring like retainer 34 that loosely encircles the associate push rod 20 and which is operatively secured to an associate, rocker arm 23 by a U-shaped wire yoke 35. The wire yoke 35 is suitably secured at its open ends to the retainer 34. As illustrated, the closed loop end of the yoke 35 is pivotably engaged in a notched portion 27*a* at the socket 25 end of the associate rocker arm 23, the rocker arm 23 at the notched portion 27*a* being shaped in cross section so as to conform to the arcuate shape of the closed end of the yoke 35.

Thus with this arrangement, the spring force on the subject valve train mechanism is divided between the poppet valve 12 and the push rod 20. As is well known, in a conventional push rod type valve train, the conventional valve return spring is always compressed when the cam lobe raises the push rod, that is, the valve always opens per cam revolution. In addition, as is well known in the art, the bias force of a valve return spring is preselected so that the valve train is, in effect, a substantially balanced spring/mass system. However, in a variable valve lift mechanism, as disclosed in the above-entitled U.S. Pat. No. 4,638,773, by design, the valve does not always open and sometimes only opens slightly. Therefore, in such a variable valve lift mechanism, the valve return spring, at no lift or lower lift operation, is not compressed or compressed sufficiently so as to produce a force to keep the push rod riding on the cam lobe. Accordingly, in the subject valve train mechanism shown, the spring 3, when compressed by the rise portion of the cam 21*a*, is used to insure a sufficient return force on the push rod 20 and tappet 22 against the cam 21*a* and to retain the rocker arm 23 and push rod 20 in operative relationship with each other.

Accordingly, in a particular engine embodiment, the force of each spring 17 and 33 was selected to equal one-half the force of a conventional valve return spring for the valve train balanced spring/mass system for that engine application. However, if desired, the respective force of the springs 17 and 33 can vary from 40%–60% to 60%–40% relative to the force of a conventional valve return spring or, alternatively, the total forces of the springs 17 and 33 can be slightly greater than that of a conventional valve return spring for a given engine application while still providing for a substantially balanced spring/mass valve train system.

Referring now to the actuator shaft housing 40, it is provided on one the left-hand side thereof, with reference to FIGS. 2, 4, 5 and 6, with a pair of spaced apart, longitudinally extending actuator shaft bores 42, each of these bores having an actuator shaft 43 rotatably journaled therein whereby each such actuator shaft can be selectively rotated by a suitable drive mechanism, not shown, for a purpose to be described, only the right hand actuator shaft 43 being shown. One of these actuator shafts can be referred to as an exhaust actuator shaft, the other then being an inlet actuator shaft.

Each of these actuator shafts 43 is provided with a plurality of axially spaced apart eccentrics or cam lobes 43*a* thereon corresponding in number to the number of cylinders in the bank of cylinders. Thus three such cam lobes 43*a* would be used in one bank of three cylinders in a V-6 engine, although, preferably, each actuator shaft 43 is provided with six such cam lobes 43*b* so as to allow these actuator shafts to be interchanged with each other. In the particular embodiment shown, the profile of each cam lobe 43*a* was selected to produce a desired lineal travel of from 0 to 0.353 inches between the position shown in FIGS. 5 and 6 and the position shown in FIGS. 2 and 4 during 238 degrees of rotation of the respective actuator shaft.

The actuator shaft housing 40 is also provided with an in-line plurality of vertical bores 44, one for each of the poppet valves 12, intake and exhaust, in the bank of cylinders. Each bore 44 is located so as to extend down between the actuator shaft bores 42 such that the vertical axis thereof is located substantially mid-way between the pair of spaced apart guide surfaces 41*a* defining the sides of a respective slot 41 in the actuator shaft housing 40, and each such bore 44 is sized so as to slidably receive the annular upright leg 45*a* of an L-shaped slide pin 45, while the base 45*b* of this slide pin 45 will extend to one side in a position to be engaged by an associated cam lobe 43*a* on an actuator shaft 43.

Thus with reference to FIG. 2 and as an example, if the right hand actuator shaft 43 is the inlet actuator shaft, then all of the slide pins 45 for the inlet valves 12 would be positioned as shown in FIG. 2, while the slide pins 45 for the exhaust valves 12 would be rotated from the slide pin 45 shown in FIG. 2 whereby they would then have their bases 45*b* positioned to be actuated by the left hand actuator shaft, not shown, that is thus the exhaust actuator shaft in this example.

As shown, each leg 45*a* of a slide pin 45 is provided with a through bore 45*c* having internal threads in a portion thereof so as to adjustably threadingly receive an adjusting screw 46 that is adapted to then be locked by a lock nut 47 for a purpose to be described hereinafter.

The actuator shaft housing 40, as shown in FIGS. 2–6, is provided with a blind bore 48 laterally aligned in spaced apart relationship to an associate, bore 44 at a location so as to be substantially co-axial with the reciprocating axis of an associate, poppet valve 12, with such blind bore 48 intersecting longitudinally extending oil supply passage 49 adapted to be supplied with pressurized engine lubricating oil in a conventional manner.

Each blind bore 48 is sized so as to slidably receive the cup-shaped cylinder member 50*a* of a conventional hydraulic lash adjuster generally designated 50. Since the construction of such a hydraulic lash adjuster 50 is well known, it is not deemed necessary to describe such a hydraulic lash adjuster, as shown, in detail herein. However, as is well known and as shown in FIG. 2, in a conventional hydraulic lash adjuster of the type illustrated, so-called pump up or axial extension of the cylinder member 50*a* relative to the plunger 50*b* can be rapidly accomplished by pressurized hydraulic fluid, such as engine lubricating oil, flowing into the pressure chamber 50*c* of the unit, whereas axial retraction of the cylinder member 50*a* relative to the plunger 50*b* is relatively slow because such retraction is effected as a result of the controlled leak-down of hydraulic fluid from the pressure chamber 50*c* in a manner well known in the art.

The actuator shaft housing 40 on the side thereof opposite to the actuator shaft bores 42, the right hand side with reference to FIGS. 2, 4, 5 and 6, is provided with a plurality of longitudinally spaced apart internally threaded bores 4*c* for receiving socket head cap screws 51 used to secure a reaction lever hold down bracket 52. As shown, for example in FIG. 1, the reaction lever hold down bracket 52 adjacent to each poppet valve 12 is provided with a tubular plunger guide 52*a*, each of which is secured as by welding to its bracket 52. Each plunger guide 52*a* is adapted to slidably receive an associated hold down plunger 53 which is biased axially downward, with reference to FIGS. 2, 4, 5 and 6, by a spring 54 operatively engaging an annular, radially outwardly extending flange 53*a* of the associated hold down plunger 53 for a purpose to be described.

Referring now to the reaction member 60, it is in the form of a lever arm which intermediate its ends is of inverted U shaped, and thus includes a base 61 with depending, spaced apart side walls 62. As is best seen in FIGS. 2 and 4–6, one end or the eccentric engaging end 61*a* of the base 61 of reaction member 60, the left hand end with reference to these Figures, is positioned so as to be engaged by the screw 46 carried by the side pin 45, while the opposite or right hand end 61*b* of the base is located so as to be engaged by the hold down plunger 53. Base 61, of the reaction member 60 next adjacent to the end 61*b*, is provided with a semi-circular boss 61*c* upstanding from its upper surface at a predetermined location whereby this boss 61*c* will be engaged by the closed end of cylinder member 50*a* of a hydraulic lash adjuster 50, as seen in FIGS. 2–6. As will now be apparent, screw 46 can be adjusted to provide for the proper angular original orientation of the reaction member 60, as desired.

In addition, the side walls 62 are each provided with an outward extending bearing arm 62*a*, which is also of semi-circular external configuration and formed concentric to boss 61*c*. These bearing arms 62*a* are sized so as to be pivotable in spaced apart, arcuate ended slots 40*a* provided for this purpose in the right hand end, with reference to FIGS. 2 and 4–6, of the actuator shaft housing 40, and also shown in FIG. 3. These side walls 62, on their inboard surfaces, are each provided with a semi-circular groove 62*b*, each of which at its upper end, blends into the lower surface of base 61 whereby to define a slotted end opening of a size to guidingly receive a respective bearing arm 23*a* of rocker arm 23, as is best seen in FIG. 6.

In the construction shown, the base 61 of the reaction member 60 is provided with a lower flat working surface 61*d* of an extent so as to cooperate with the cam surface 26 of the rocker arm 23 whereby to operate as a fulcrum for the rocker arm 23 so that the latter can, in effect, be operatively adjustably fixed for pivotable movement relative to the reaction member 60 so as to control the opening and closing movement of the associated valve 12. It will be appreciated by those skilled in the art that alternatively, if desired, the upper surface of the rocker arm 23 could be flat while the cam surface 26 could be provided on the lower surface of base 61 of reaction member 60.

Also, in the construction shown and as illustrated in FIGS. 2 and 4–6, the subject valve train is preferably enclosed by a valve cover 70, the lower edge of which rests on a seal retainer 71, supporting a seal 72 engaged in a suitable slot provided for this purpose in the cylinder head 10. Also as shown, the actuator shaft housing 40 is provided with an upstanding externally threaded boss 40*c* at each bore 44, with each boss 40c extending through an associated opening 70*a* in the valve cover 70. Each boss 40*c* is provided with a seal 73 encircling its lower end and a nut 74 is threaded thereon to effect axial retention of the valve cover 70. Preferably, as shown, a closed cap nut 75 is also threaded on each such boss to serve as both a lock for the associated nut 74 and to enclose the associated bore 44 at the boss 40*c* end of the actuator shaft housing 40.

Also in the construction illustrated and as shown in FIG. 2, each rocker arm 23 is provided with an internal oil passage 76 in flow communication at one end with socket 25 and adjacent to its opposite end in flow communication with a second oil passage 77 that is in communication with socket 24. In addition, a riser passage 78 extends upward from passage 76 so as to open out through the notched portion 27*a* of the rocker arm 23. With this arrangement, pressurized engine lubricating oil supplied via a conventional oil gallery 80 in the cylinder block 11 to the hydraulic tappet 24 can then flow up through the hollow push rod 20 and then via passages 76, 77 and 78 so as to provide lubrication to the operative surfaces of sockets 24 and 25 and to the notched portion 27*a*.

OPERATION OF THE VALVE TRAIN

Reference is now made to FIGS. 2 and 4–6. As shown in these figures, the rocker arm 23 is always urged into contact with the reaction member 60 by the bias force of the valve return spring 17 acting through valve 12 and of course by the previously described mechanical linkage of the rocker arm 23 to the push rod 20. At the same time, the spring 54 biased plunger 53 engages the right hand end 61*b*, with reference to these Figures, of the reaction member 60 causing the reaction member 60 to pivot about the interface of its boss 61*c* and the lower closed end of the cylinder member 50*a* of the hydraulic lash adjuster so that the opposite end 61*a* engages adjusting screw 46, through any vertical up or down movement of the cylinder member 50*a* to effect lash adjustment.

At the same time lateral movement of the reaction member 60 to either the left or right, with reference to FIGS. 2 and 4–6, is substantially prevented by the sliding engagement of the bearing arms 62*a* thereof in the slots 40*a* of the fixed actuator shaft housing 40.

Figure 4:
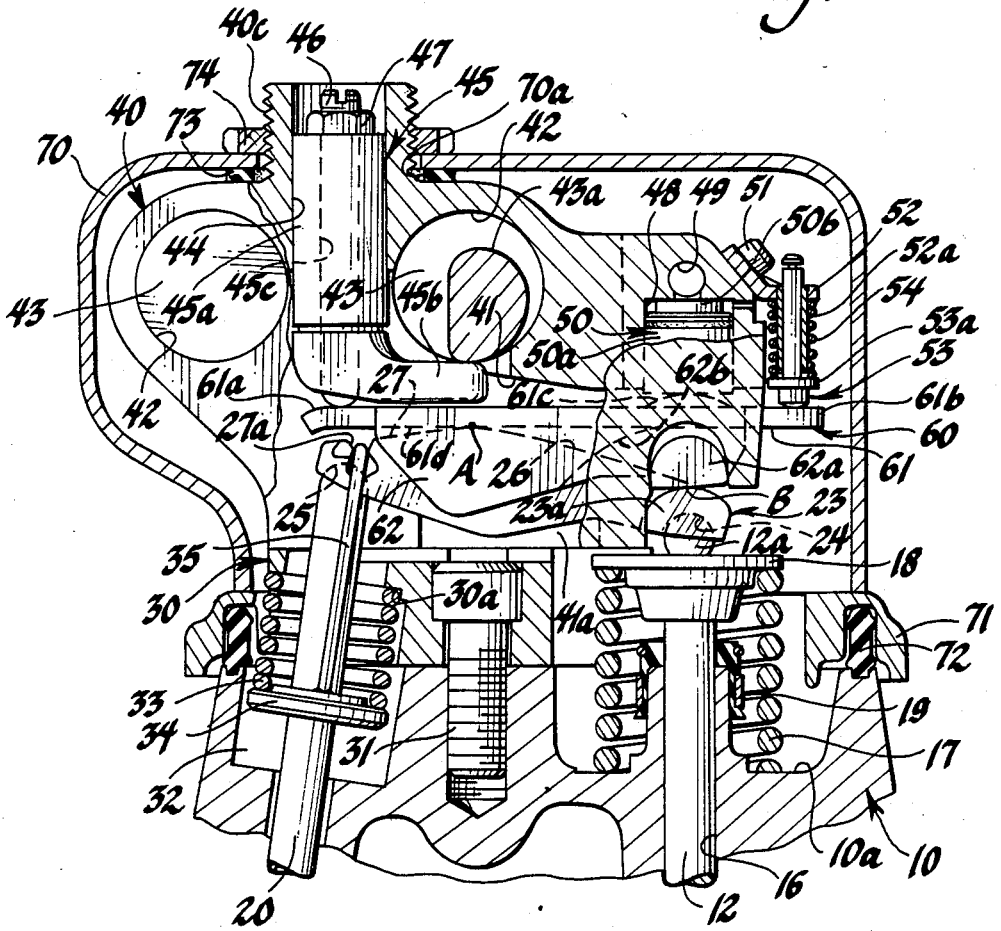
FIG. 4 is a view similar to that of FIG. 1 but with the rocker arm rotated fully in a valve opening direction.

Reference is now made to FIGS. 2 and 4 with FIG. 2 showing the position of the rocker arm 23 in the valve 12 closed position and reaction member 60 positioned for full lift of valve 12 and FIG. 4 being similar to FIG. 2 but showing the rocker arm 23 having actuated the valve 12 to the full lift open position.

During initial rotation of the cam 21*a*, the rocker arm 23 is launched on a pivotal cycle prior to valve 12 actuation, from the position shown in FIG. 2, to acquire the desired necessary velocity, which is then nominally held constant during rotation of the cam 21*a* in degrees of rotation. During this initial pivoting movement of the rocker arm 23, it is free to pivot about the first axis X and, thus does not effect any axial movement of the valve 12.

For maximum valve 12 lift, the eccentric cam 43*a* is, as described above, positioned as shown in FIGS. 2 and 4, with the reaction member 60 thus moved to its most counterclockwise position about pivot axis Y at the closed end of the cylinder member 50*a* of the hydraulic lash adjuster 50, so that valve 12 motion begins when point A, on rocker arm 23 pivots on reaction member 60 and the valve 12 begins to lift with the actual valve 12 lift profile being determined by the cam surface 26 contour between points AB, which can be contoured in a manner as desired. As lift continues, the rocker arm 23 essentially pivots about line point A, as seen in FIG. 4, and the valve 12 lift profile is determined by the high lift portion of the lobe of cam 21*a*. The landing or valve seating profile is the reverse of the opening profile and is determined by the cam surface 26 contour between AB.

Figure 5:
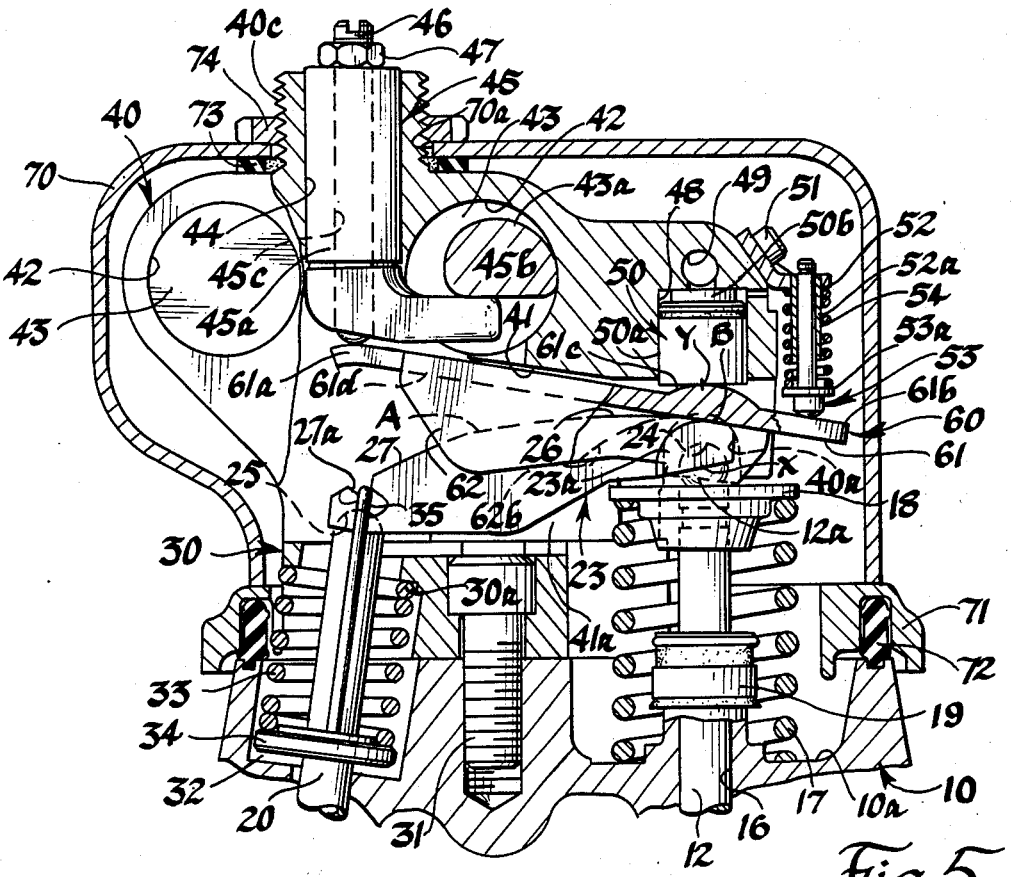
FIGS. 5 and 6 are views corresponding to those of FIGS. 2 and 4, respectively, but showing the upper reaction member pivotably moved to a position to effect zero lift of the poppet valve.
Figure 6:
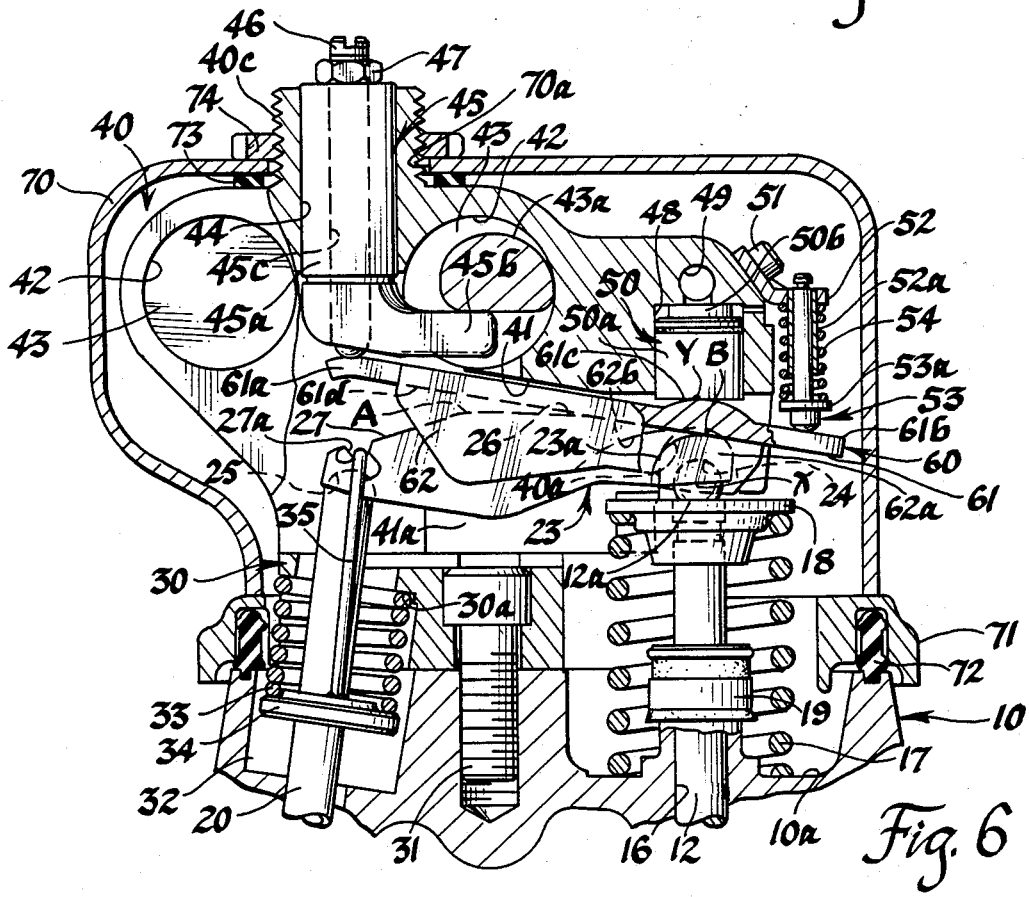

Valve 12 lift can be reduced by angular movement of the eccentric 43 to move cam 43*a* so that the upper reaction member 60 will pivot in a clockwise direction from the position shown in FIGS. 2 and 4 to the position shown in FIGS. 5 and 6. Thus if the upper reaction member 60 is pivoted in a clockwise direction to a position intermediate from that which is shown in FIGS. 2 and 4 and the position shown in FIGS. 5 and 6, additional lost motion is introduced so as to delay the point at which valve 12 motion begins. In this example, rocker arm 23 essentially pivots between the flat working surface 61*d* of the reaction member 60 and the semi-spherical end of valve 12. When valve 12 lift begins, the lift off profile is the same as with maximum lift because this profile is still determined by the cam surface 26 contour between AB and the high lift portion of the lobe of cam 21*a*. Thus, with the subject valve train mechanism the lift-off and landing profiles of the valve 12 are unchanged by the amount of lost motion.

Referring now to FIGS. 5 and 6, it will be seen that if the eccentric 43 is rotated to the position shown the reaction member 60 will pivot about pivot axis Y in a clockwise direction to its maximum clockwise extent, the position illustrated in these Figures. In this position of the reaction member 60, during rotation of the operating cam 21*a* to effect upward movement to the push rod 20 position shown in FIG. 6, it will merely cause the rocker arm 23 to pivot about the pivot axis X, resulting in zero lift of the valve 12, with the cam surface 26 between AB never coming into direct working engagement with the lower flat working surface 61*d* of the reaction member 60. Stated in a somewhat different manner, in this angular position of the reaction member 60, point B on the cam surface 26 profile is located, with reference to FIGS. 2, 4, 5 and 6, at a position slightly to the left of the reciprocating axis of the valve 12 and, thus, in effect, the reaction member 60 is angularly positioned so that it cannot serve as a fixed fulcrum for the cam surface 26 contour on the rocker arm 23. Accordingly, it will now be apparent that the subject valve train mechanism can also be used to deactivate a valve.

By locating point B of the cam surface 26 contour on the rocker arm 23 slightly to the left of the axis of the valve 12, with reference to FIGS. 2, 4, 5 and 6, the rocker arm 23 during initial pivotal movement is thus free to pivot about axis point X to obtain a desired velocity before the cam surface 26 contour can possibly engage the opposed working surface of the upper reaction member 30.

It will be apparent to those skilled in the art that there may be other ways by which the cam surface 26 profile may be obtained so as to provide for a desired lift-off and landing profile for the valve 12 in a particular engine application. However, it should also now be apparent that the lift-off and landing of the valve 12 should preferably occur during the nearly constant velocity portion of the preselected cam 21*a* profile, so that the lift-off and landing profile for the valve 12 will be substantially the same. It will also be apparent that as the valve 12 approaches maximum lift, for a particular angular position of the upper reaction member 60, the cam 21*a* lift velocity is slowing to zero and, of course, with this arrangement, the lift-off and landing profiles will be relatively gradual. The result is a smooth opening of the valve 12 and substantially no impact at closing of the valve 12 for all lifts at all engines speeds.

While the invention has been described with reference to the structure disclosed herein, it is not intended to be confined to the specific details set forth, since it is apparent that many modifications and changes can be made by those skilled in the art. For example, the same variable valve lift function can be achieved by forming the cam surface contour on the reaction member and using an opposed flat working surface on the rocker arm. This application is therefore intended to cover such modifications or changes as may come within the purpose of the improvements or the scope of the following claims.

The embodiments of the invention in which an exclusive property or privilege is claimed are defined as follows:

1. A variable lift, valve train for an internal combustion engine of the type having a body means defining a cylinder with a port, said valve train including a valve with an axially extending valve stem located for axial movement between a valve closed an a valve open position relative to said port and normally biased to a valve closed position; a valve actuator spaced from said valve and operable to effect reciprocation of said valve; a rocker arm pivotably supported at one end on said valve stem and at its other end engaging said valve actator; spring means mechanically interconnecting said valve actuator with said rocker arm, said body means including fixed overhead support means extending in part over said rocker arm and spaced therefrom a predetermined distance; a lash adjuster including movable cylinder member means operatively positioned in said overhead support means with said cylinder member means having an outboard closed end projecting toward said valve stem in substantially coaxial alignment therewith, an eccentric means including an angularly movable eccentric operatively located in said overhead support means so as to substantially overlie said other end of said rocker arm, a reaction member pivotably supported adjacent to one end thereof by said outboard end of said cylinder member means, the opposite end of said reaction member being adapted to be engaged by said eccentric means; and a spring biased plunger means operatively supported by said overhead support means in position to abut said one end of said reaction member to bias said opposite end of said reaction member into engagement with said eccentric means; said reaction member and said rocker arm having opposed working surfaces one of which is flat and the other of which has a cam surface contour of a predetermined profile.

2. A valve train for an internal combustion engine of the type having a body means defining a cylinder with a port, said valve train including a valve with an axially extending v alve stem located for axial movement between open and closed positions of the valve relative to said port, a first spring means operatively connected to said valve to normally bias said valve to said closed position, a valve actuator spaced from said valve and operable to effect reciprocation of said valve, a rocker arm pivotably supported at one end on said stem and at its other end engaging said valve actuator, a second spring means operatively interconnecting said rocker arm with said valve actuator, said body means including a fixed overhead support means having a part thereof extending over said rocker arm with said part spaced from said rocker arm a predetermined distance, a hydraulic lash adjuster operatively positioned in said overhead support means, said hydraulic lash adjuster including an axially movable closed end cylinder member, said closed end projecting from said overhead support means toward said valve stem in substantially coaxial alignment with the axis of movement of said valve, an eccentric means including a pivotal eccentric and a slidable pin means operatively positioned in said overhead support means in spaced apart relationship to said lash adjuster so as to substantially overlie said other end of said rocker arm, a reaction member pivotably supported adjacent to one end thereof by said closed end of said cylinder member, said reaction member having an opposite end adapted to be engaged by said eccentric means, and a spring actuated plunger means operatively associated with said reaction member to bias said opposite end of said upper reaction member into engagement with said slidable pin means; said reaction member and said rocker arm having opposed working surfaces one of which is flat and the other of which has a cam surface contour of predetermined profile such that after a predetermined pivotable movement of said rocker arm said opposed working surfaces are in operational contact with each other whereby said working surface of said reaction member can serve as a fulcrum for pivotable movement of said rocker arm to effect opening movement of said valve, the amount of lift and timing of said valve being controlled by the angular position of said pivotable eccentric.

3. A variable lift valve train for an internal combustion engine of the type having a body means defining a cylinder with a port, said valve train including a valve with an axially extending valve stem located for axial movement between an open position and a closed position of the valve relative to said port, a first spring means operatively connected to said valve to normally bias said valve to said closed position, valve actuator means spaced from said valve and operable to effect reciprocation of said valve; a rocker arm pivotably supported at one end on said valve stem and at its other end engaging said valve actuator means; a yoke means, including a second spring mans, interconnecting said rocker arm with said valve actuator means; said body means including a fixed overhead support means having a portion thereof extending over said rocker arm and spaced therefrom a predetermined distance; a hydraulic lash adjuster having a cylinder member with a closed end operatively positioned by said overhead support means with said closed end of said cylinder member projecting toward said valve stem in subsantial coaxial alignment therewith; an eccentric means including a pivotable eccentric and a slide pin means operatively positioned in said overhead support means; a reaction member pivotably supported at one end by said closed end of said cylinder member with the opposite end thereof being adapted to be engaged by said eccentric means; and, a spring biased plunger means operatively associated with said reaction member to effect pivotable movement of said reaction member about said closed end of said cylinder member whereby to bias said opposite end of said reaction member into engagement with said slide pin means; said reaction member having a flat working surface and said rocker arm having an opposed cam surface contour thereon whereby, from a valve closed position, after a predetermined pivotable movement of said rocker arm said opposed working surfaces are in operational contact with each other so that said working surface of said reaction member can serve as a fulcrum for pivotable movement of said rocker arm to effect opening movement of said valve, the amount of lift and timing of said valve being controlled by the angular position of said eccentric and thus of said reaction member.

4. A variable lift valve train according to claim 3 wherein said first spring means has a bias force of from 40% to 60% and said second means has a bias force of from 60% to 40% of the total spring force required for said valve train to be a substantially balanced spring-/mass system.

* * * * *